US008458855B2

(12) United States Patent
Wilmo

(10) Patent No.: US 8,458,855 B2
(45) Date of Patent: Jun. 11, 2013

(54) HOPPER ASSEMBLY WITH FILTER MODULE FOR SURFACE MAINTENANCE MACHINE

(75) Inventor: Michael Stewart Wilmo, Plymouth, MN (US)

(73) Assignee: Tennant Company, Minneapolis, MN (US)

( * ) Notice: Subject to any disclaimer, the term of this patent is extended or adjusted under 35 U.S.C. 154(b) by 693 days.

(21) Appl. No.: 12/396,440

(22) Filed: Mar. 2, 2009

(65) Prior Publication Data

US 2009/0217480 A1 Sep. 3, 2009

Related U.S. Application Data

(60) Provisional application No. 61/032,908, filed on Feb. 29, 2008.

(51) Int. Cl.

| | |
|---|---|
| ***A47L 9/10*** | (2006.01) |
| ***A47L 9/20*** | (2006.01) |
| ***B01D 41/00*** | (2006.01) |
| ***B01D 45/18*** | (2006.01) |
| ***B01D 46/04*** | (2006.01) |

(52) U.S. Cl.
USPC ..... 15/352; 55/300

(58) Field of Classification Search
USPC ..... 15/352; 74/61, 87; 366/128; 55/300
See application file for complete search history.

(56) References Cited

U.S. PATENT DOCUMENTS

| | | | | |
|---|---|---|---|---|
| 2,543,342 | A * | 2/1951 | Timm | 55/283 |
| 3,320,725 | A * | 5/1967 | Foster | 55/283 |
| 4,007,026 | A * | 2/1977 | Groh | 55/302 |
| 4,970,004 | A | 11/1990 | Rosaen | |
| 5,013,333 | A * | 5/1991 | Beaufoy et al. | 95/20 |
| 5,295,602 | A * | 3/1994 | Swanson | 220/786 |
| 5,605,554 | A * | 2/1997 | Kennedy | 55/493 |
| 5,647,093 | A * | 7/1997 | Engel et al. | 15/352 |
| 6,428,590 | B1 | 8/2002 | Lehman et al. | |
| 6,742,219 | B2 * | 6/2004 | Lenzmeier et al. | 15/345 |
| 6,966,097 | B2 * | 11/2005 | Engel et al. | 15/348 |
| 7,803,205 | B2 * | 9/2010 | Oh et al. | 55/337 |
| 7,935,160 | B2 * | 5/2011 | Holzmann et al. | 55/337 |

OTHER PUBLICATIONS

International Search Report and Written Opinion of the International Searching Authority mailed Apr. 28, 2009 for PCT/US2009/035779.
International Preliminary Report on Patentability for PCT? US2009/035779, mailed Sep. 10, 2010.

* cited by examiner

*Primary Examiner* — Bryan R Muller
(74) *Attorney, Agent, or Firm* — Briggs and Morgan, P.A.

(57) ABSTRACT

A mobile surface maintenance machine with a debris hopper and a filter module providing at least two filter stages for separating dust and debris within the debris hopper, the filter module including a filter shaking mechanism and a housing adapted to seal against the upper opening of the debris hopper, and wherein the debris hopper is removed from air communication with the exhaust fan when the debris hopper is in a debris dump configuration and is returned to air communication with the exhaust fan when the debris hopper is lowered into an operational configuration.

13 Claims, 21 Drawing Sheets

HOPPER ASSEMBLY WITH FILTER MODULE FOR SURFACE MAINTENANCE MACHINE

RELATED APPLICATIONS

This application claims the benefit of priority of U.S. Ser. No. 61/032,908, filed Feb. 29, 2008, which is hereby incorporated by reference in its entirety.

TECHNICAL FIELD

The present disclosure is generally directed to filtration systems for a mobile surface maintenance machine. More specifically, the present disclosure is directed to a hopper assembly adapted to utilize a modular filtration system within a surface maintenance machine.

BRIEF SUMMARY OF THE INVENTION

The present invention is directed to a hopper assembly for a mobile surface maintenance machine adaptable to support air filter modules. The filter modules have common geometry to minimize the difficulty and expense of incorporating one filter module over the other. The different filter modules are preferably vacuum-based. In one embodiment, a filter module includes a panel filter, such as a rectangular panel filter along with a filter shaking mechanism. In another embodiment, a filter module includes a cylindrical filter coupled with a cyclonic pre-filter stage. The filter modules are preferably supported on a common surface of a debris hopper and provide exhaust outlets at predetermined locations in order to couple the filter module to other vacuum conduits on the machine. A hopper assembly in accordance with the present invention may include a debris hopper with an upper flange adapted to be engaged by a frame and/or cover of different filter modules. In this regard, conversion between different filter modules can be a relatively easy process. Additionally, a common debris hopper can be utilized on machines incorporating two or more different filter technologies. This provides for greater flexibility during machine manufacturing and subsequent service.

A conventional forward throw cylindrical broom sweeper will be used by way of example in the following description of the invention. However, it should be understood that, as already stated, the invention could as well be applied to other types of mobile surface maintenance machines, such as, for example, other types of cylindrical broom sweepers and other machines such as scarifiers and various types of vacuum sweepers.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 1:
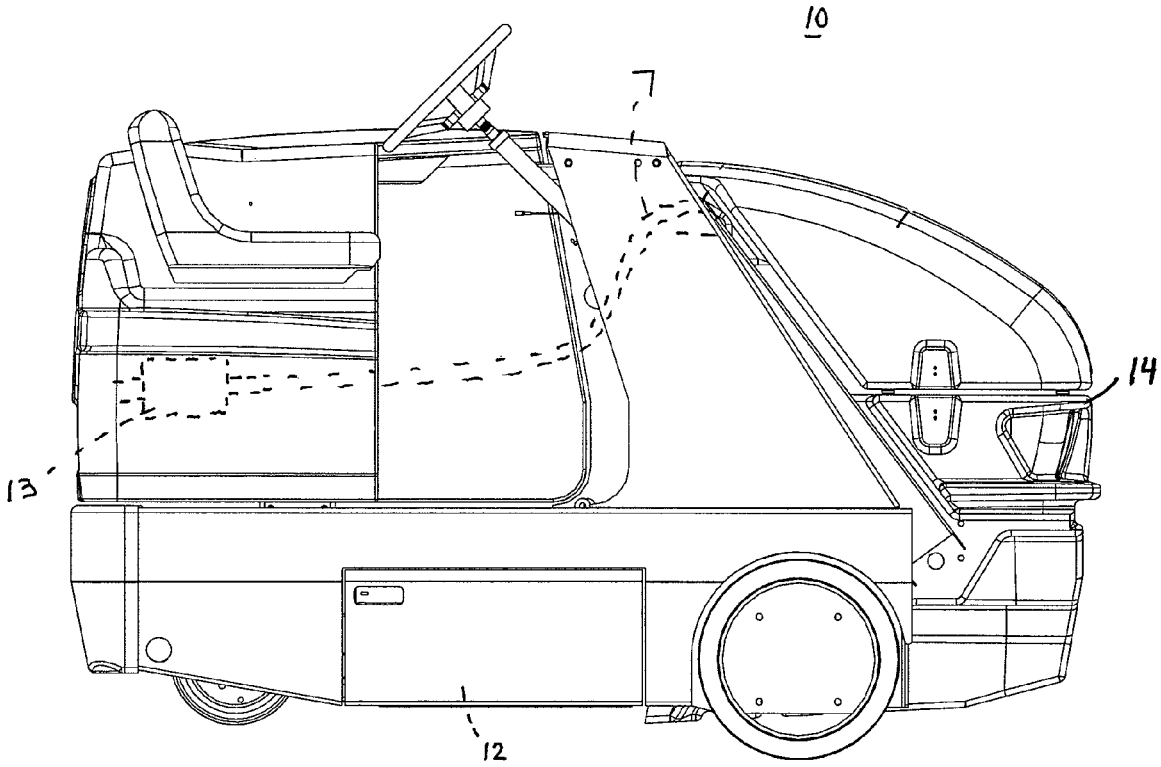
FIG. 1 is a perspective illustration of one embodiment of a cleaning machine utilizing a filter cleaning system in accordance with the present invention.

With reference to FIG. 1, there is shown an industrial sweeping machine 10. As shown, it is a forward throw sweeper. However, it could as well be an over-the-top, rear hopper sweeper, a type which is also well known in the art. It has a rotating cylindrical brush 12 for sweeping debris from a floor or other surface into a debris hopper assembly 14. Hopper arms (not shown) allow hopper assembly 14 to be lifted during a dumping procedure. The broom chamber may be enclosed by skirts which come down nearly to the floor. The skirts largely contain within the broom chamber any dust stirred up by the broom. To complete the dust control there is a suction blower or vacuum fan 13 which exhausts air from the broom chamber to the atmosphere. Prior to exhaust, the air passes through hopper assembly 14 containing a filter module. Vacuum fan 13 is coupled to the hopper assembly 14 via a vacuum conduit 7 which maintains a sub-atmospheric pressure within the broom chamber so that air is drawn in under the skirts and through the filter module prior to exhaust. As a result, relatively little dust escapes from the broom chamber to the external environment. Various components of machine 10 have been omitted from FIG. 1 to improve understanding of the aspects of the present invention.

Figure 2:
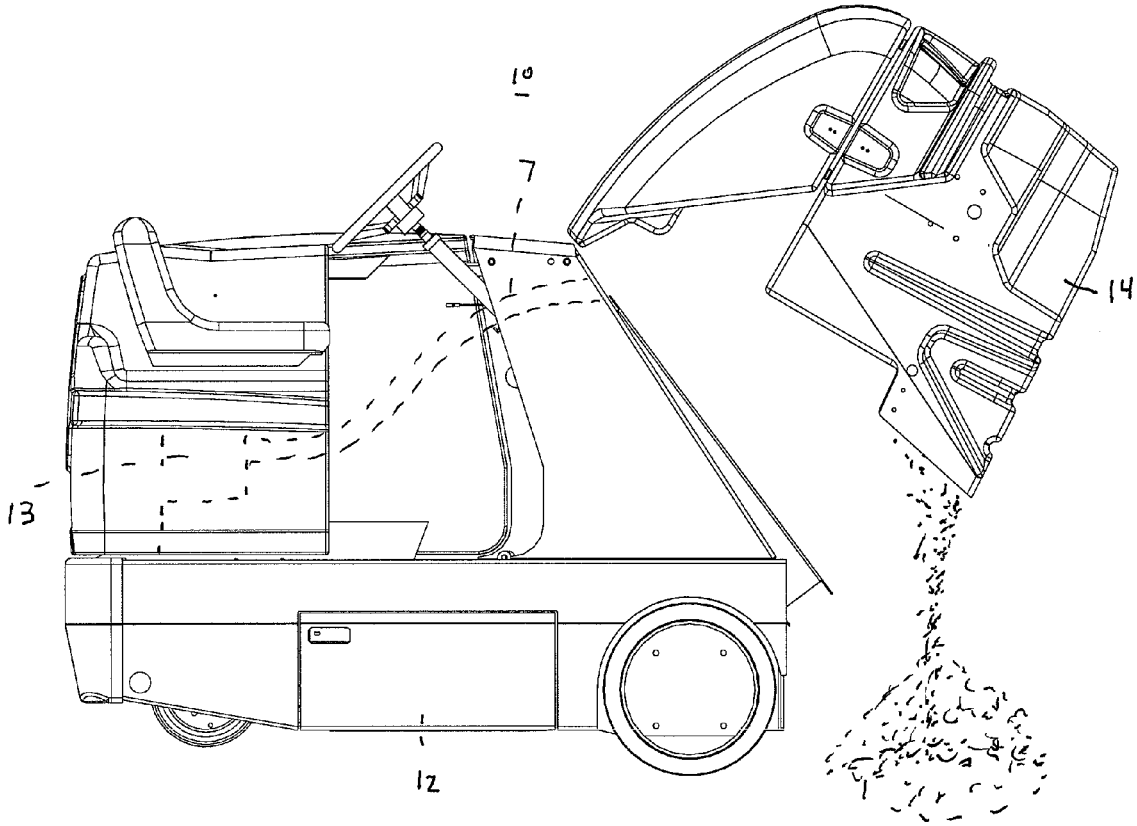
FIG. 2 is a perspective illustration of the machine of FIG. 1 during a hopper dumping procedure.

FIG. 2 depicts machine 10 during a hopper dumping procedure wherein dust and debris collected within hopper assembly 14 is discharged from the machine 10. The lift arms and associated components have been excluded for the sake of simplicity.

Figure 3:
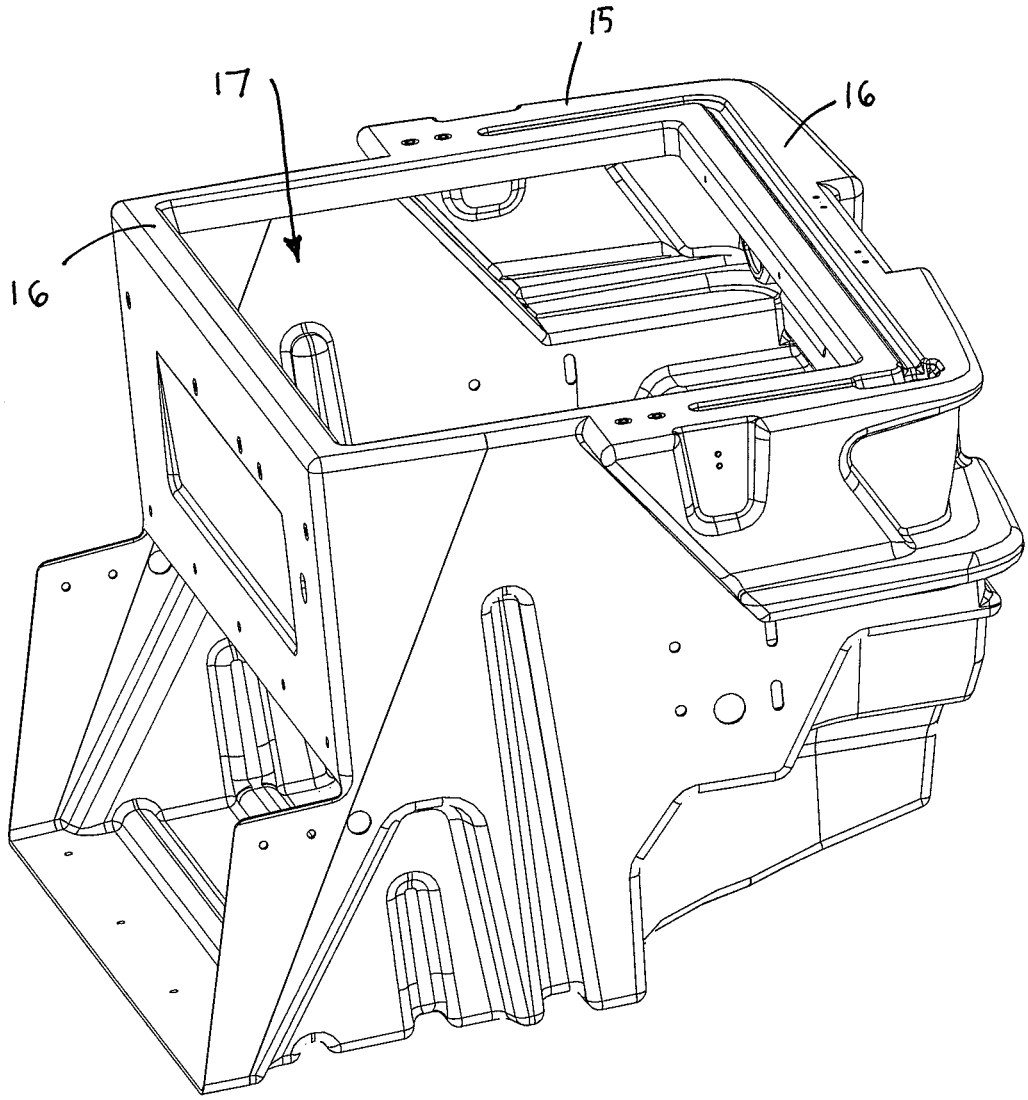
FIG. 3 illustrates a debris hopper of the embodiment of FIG. 1.

FIG. 3 is a perspective view of a debris hopper 15 of hopper assembly 14. The debris hopper 15 includes an upper flange 16 surrounding a top aperture 17. As described hereinafter, different filter modules are adapted to be supported by upper flange 16. In this regard, a common debris hopper 15 can be utilized with different filter modules.

Figure 4:
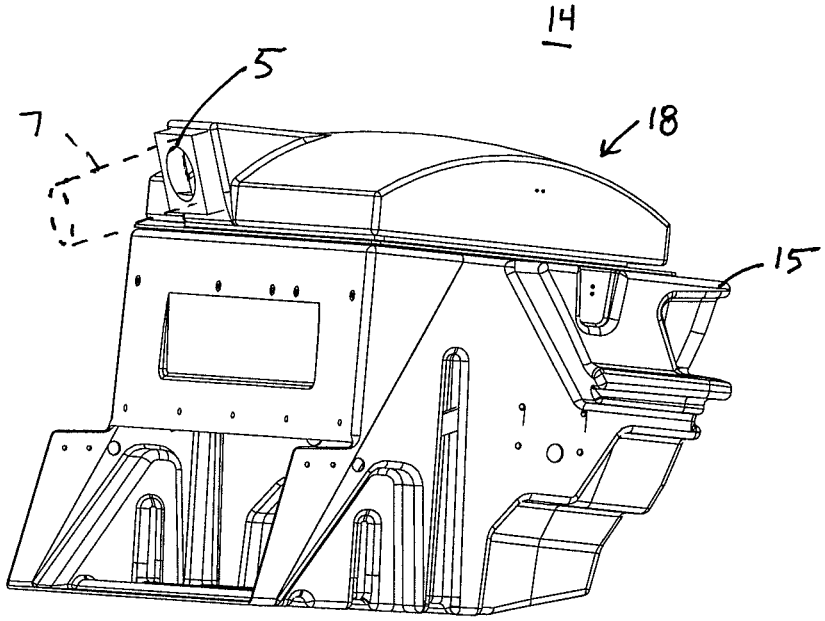
FIG. 4 is a perspective view of the hopper assembly in accordance with one embodiment of the invention.
Figure 5:
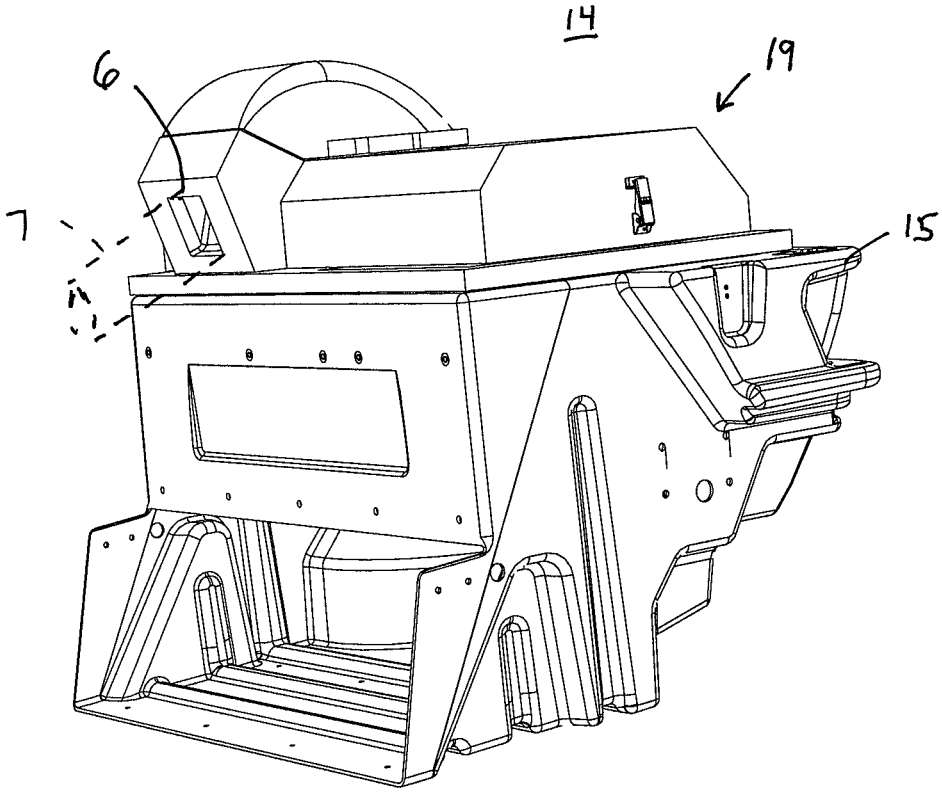
FIG. 5 is a perspective view of another hopper assembly in accordance with the invention.

FIG. 4 is a perspective view of the hopper assembly 14 supporting a panel filter module 18. Air is exhausted out of hopper assembly 14 at outlet 5. Outlet 5 is coupled with the machine's vacuum conduit 7 when the debris hopper is in an operational configuration. FIG. 5 is a perspective view of the hopper assembly 14 supporting a cylindrical filter/cyclonic separator module 19. Air is exhausted out of hopper assembly 14 at outlet 6. Outlet 6 is coupled with the machine's vacuum conduit 7 when the debris hopper is in an operational configuration. Comparing the filter modules 18, 19 of FIGS. 4 and 5, the exhaust outlets 5, 6 are provided at substantially the same locations relative to the overall assemblies. In a preferred embodiment, the exhaust outlets 5 and 6 engage similar portions of the vacuum system of the machine 10, namely exhaust conduit 7, during the sweeping operation. As a result, additional couplings or parts may be unnecessary. When the debris hopper is moved into a dump configuration, as shown in FIG. 2, the exhaust outlets 5, 6 are disconnected from vacuum conduit 7. After debris is dumped from the hopper assembly 14, the hopper assembly is lowered and vacuum conduit 7 engages the exhaust outlet 5, 6 and operation can be resumed.

Figure 6:
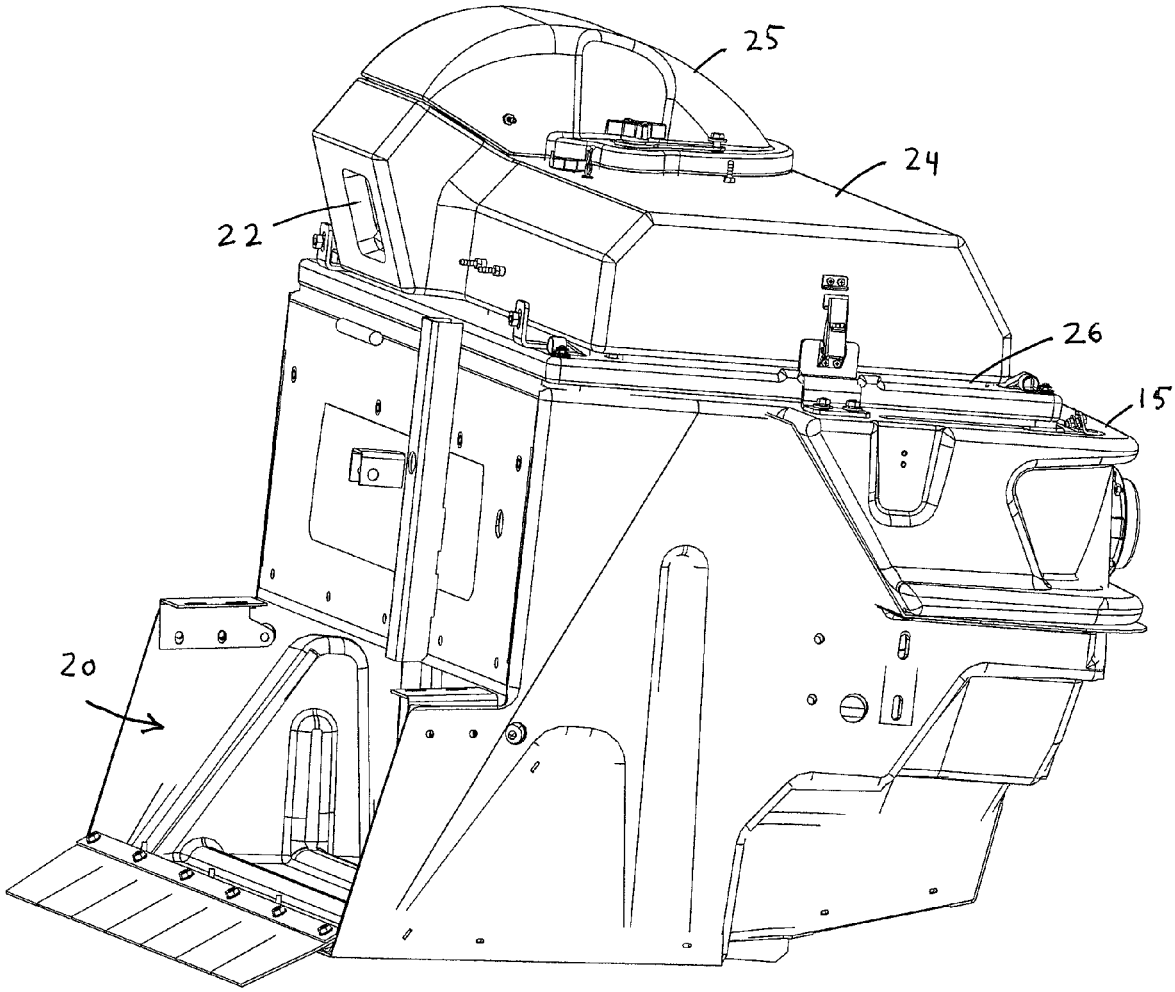
FIG. 6 is another perspective view of the hopper assembly of FIG. 5.

As shown in FIG. 6, hopper assembly 14 of machine 10 includes inlet 20 through which air-entrained dust and debris enters via a mechanical throwing action by brush 12 and a vacuum action generated by vacuum fan 13 during a sweeping operation of machine 10. Hopper assembly includes air outlet 22 through which filtered air is drawn by operation of vacuum fan 13. A mating surface surrounds air outlet 22. The mating structure engages a mating surface on machine 10 to minimize air/debris loss at the interface. During a hopper dumping procedure, dust and debris within hopper assembly 14 exits debris inlet 20. Attached to hopper assembly 14 is a filter module including main cover 24, filter cover 25 and tray 26.

Figure 7:
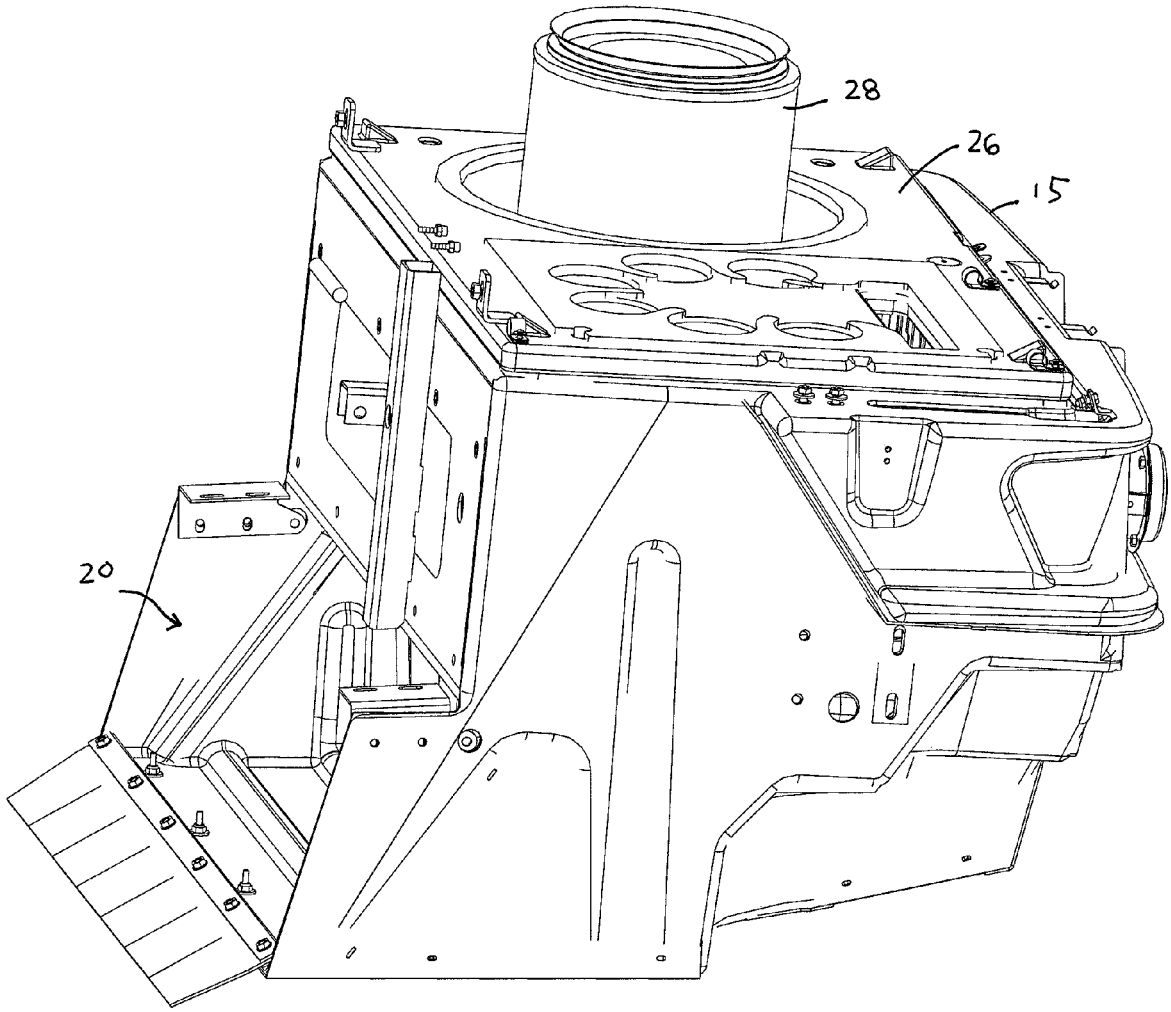
FIG. 7 is a perspective view of a hopper assembly of FIG. 6.

FIG. 7 depicts the hopper assembly of FIG. 6 with main cover 24 and filter cover 25 removed. A portion of cylindrical filter 28 is exposed. Dust is retained on outer surfaces of filter 28 as air is drawn by vacuum toward the filter center by action of vacuum fan 13. Air at the center of filter 28 is then directed through filter cover 25 toward vacuum fan 13.

Figure 8:
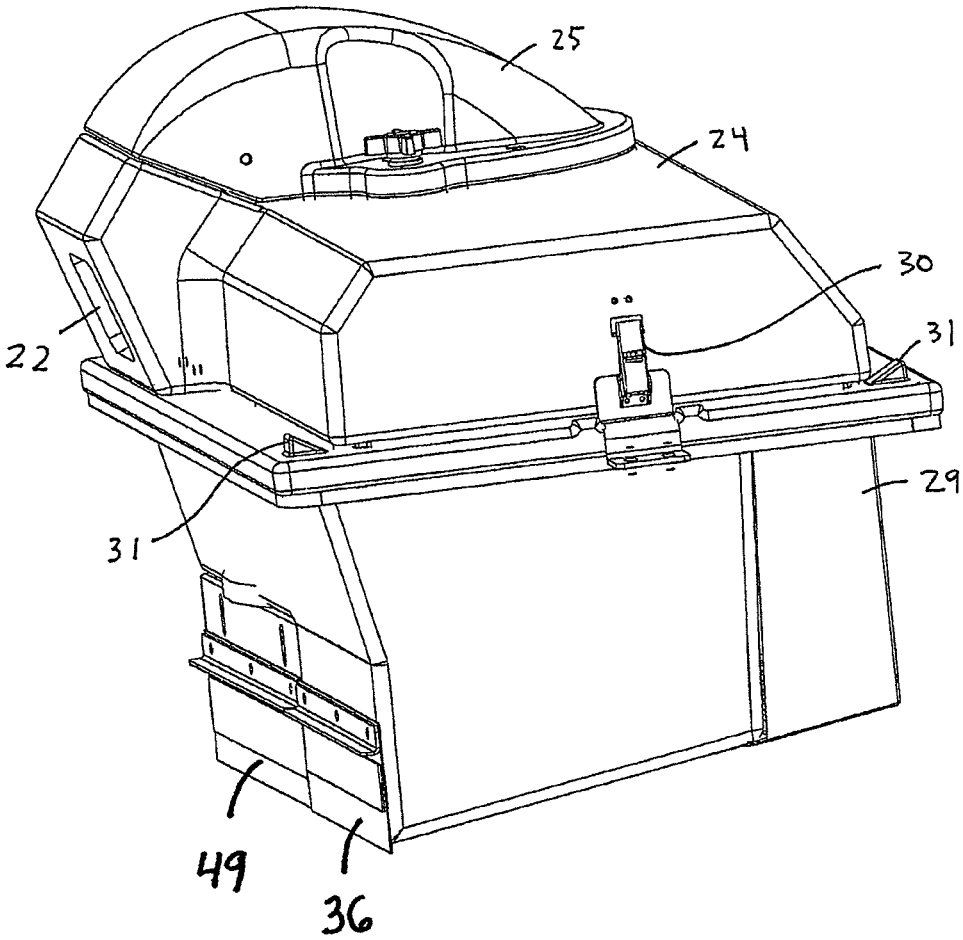
FIG. 8 is another perspective view of the hopper assembly of FIG. 6.

FIG. 8 is a perspective view of cylindrical filter/cyclonic separator module 19. Filter cover 24 is retained to module housing 29 via a pair of latching connectors 30. A plurality of positioning ramps 31 are provided to guide cover 24 into proper orientation relative to housing 29, such as during assembly or repair.

Figure 9:
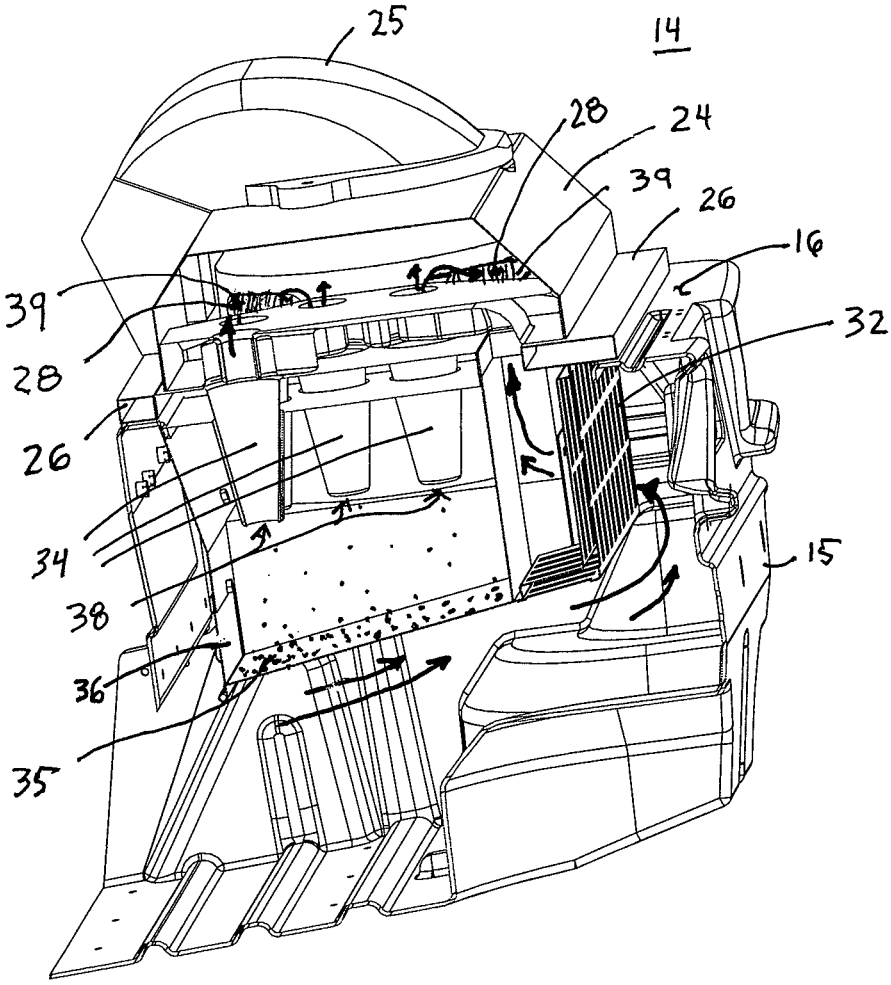
FIG. 9 is a cross-sectional view of the hopper assembly of FIG. 6.

FIG. 9 is a cross-sectional view of hopper assembly 14 of FIG. 5. In the illustrated embodiment, the filter module includes three different filter sections for removing dust and debris from an air stream, namely prefilter 32, cyclonic filters/vortex separators 34 and a cylindrical filter 28. The arrows in FIG. 9 generally depict air flow through hopper assembly 14 during machine operation. This filter system removes dust from the air stream so the vacuum fan 13 will exhaust relatively clean air to the atmosphere. The filter module includes a bank of cyclonic filters 34 through which dusty air passes causing separation and retention of at least some of the larger dust particles and debris. Dust and debris exiting the bottom apertures of cyclonic filters 34 is deposited on collection surface 35 of the filter module. During a sweeping operation, dust and debris remain on surface 35 as an outlet is sealed by flexible seal 36 by way of vacuum action. Dust and debris on surface 35 are periodically removed during a hopper dumping procedure. During such a procedure, with the vacuum fan 13 uncoupled to hopper assembly 14, seal 36 is free to swing open allowing dust and debris to pass through the outlet previously blocked by seal 36.

During machine operation, air enters the filter module through prefilters 32 and passes through the vortex separators 34 prior to being filtered by the cylindrical filter. A vortex is created by the channels and conical sections below the channels as air spirals in a path moving downward and inward, then upward in a helical path to exit at an upper opening. The centrifugal acceleration due to rapid rotation of the air causes dense particles to be forced outward to the wall of the cones of vortex separators 34. The dense particles are transported in a slow moving boundary layer downward toward the apex openings 38. During operation, air passes from vortex separators 34 through openings 39 to the cylindrical filter for subsequent filtering. Additional aspects of the vortex separators 34 are disclosed in applicant's copending U.S. patent application CYCLONIC FILTER FOR SURFACE MAINTENANCE MACHINE Ser. No. 12/044,874, filed Mar. 7, 2008, and incorporated by reference herein.

Figure 10:
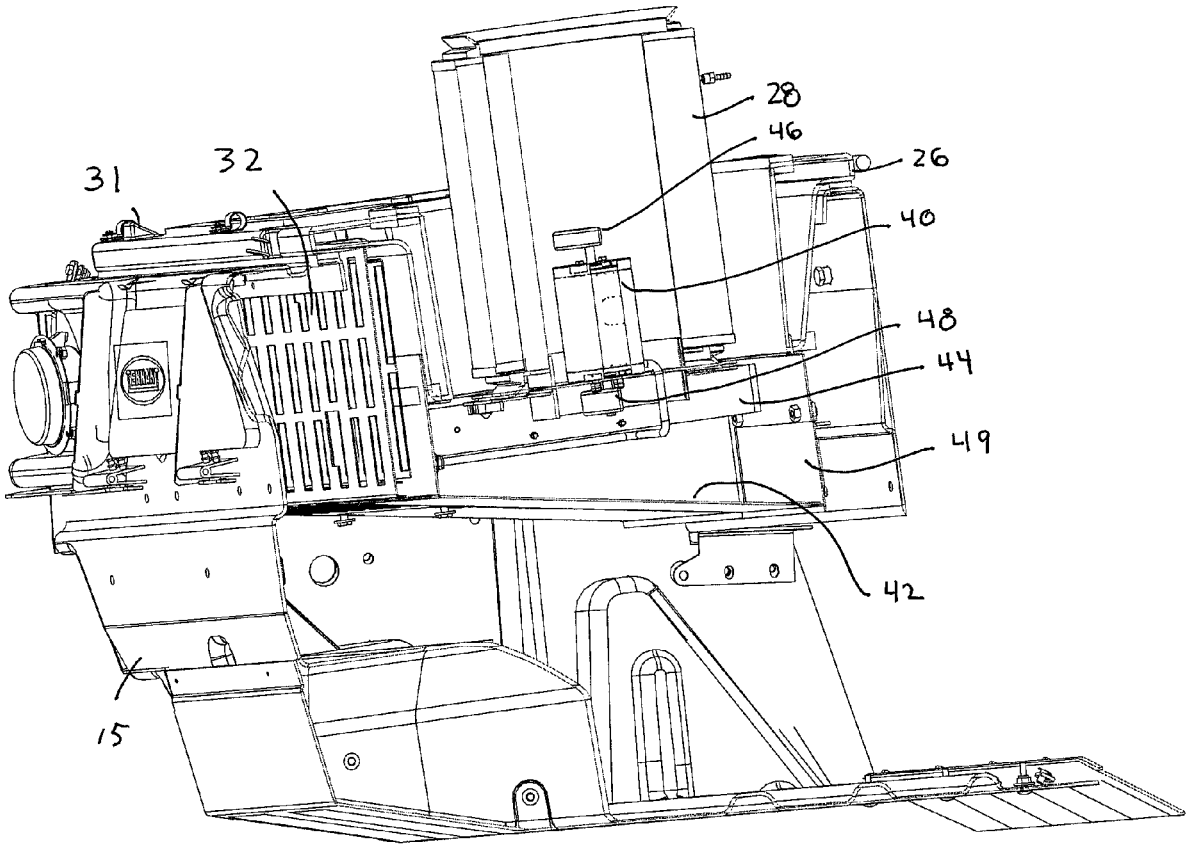
FIG. 10 is a cross-sectional view of the hopper assembly of FIG. 6.

FIG. 10 is a cross-sectional view of hopper assembly 14 of FIG. 6. Cylindrical filter 28 is shown in cross section with a shaker motor 40 positioned within the central open interior of filter 28. Filter 28 and shaker motor 40 are supported above collection surface 42 by support arms 44. Shaker motor 40 is coupled to a pair of eccentric weights 46, 48 which are periodically rotated to impart a shaking action to filter 28. Dust and debris removed from outer surfaces of filter 28 via a filter shaking procedure drop onto collection surface 42. During a sweeping operation, flexible seal 49 is held closed by vacuum action thereby retaining debris on collection surface 42. During a hopper dumping procedure with vacuum fan 13 uncoupled, flexible seal 49 opens to release debris on collection surface 42 for passage out of hopper assembly 14 at inlet opening 20. Additional aspects of the filter shaking mechanism are disclosed in applicant's copending U.S. patent application FILTER SHAKER ASSEMBLY FOR SWEEPING MACHINE Ser. No. 12/396,398, filed on Mar. 2, 2009, and incorporated by reference herein.

Figure 11:
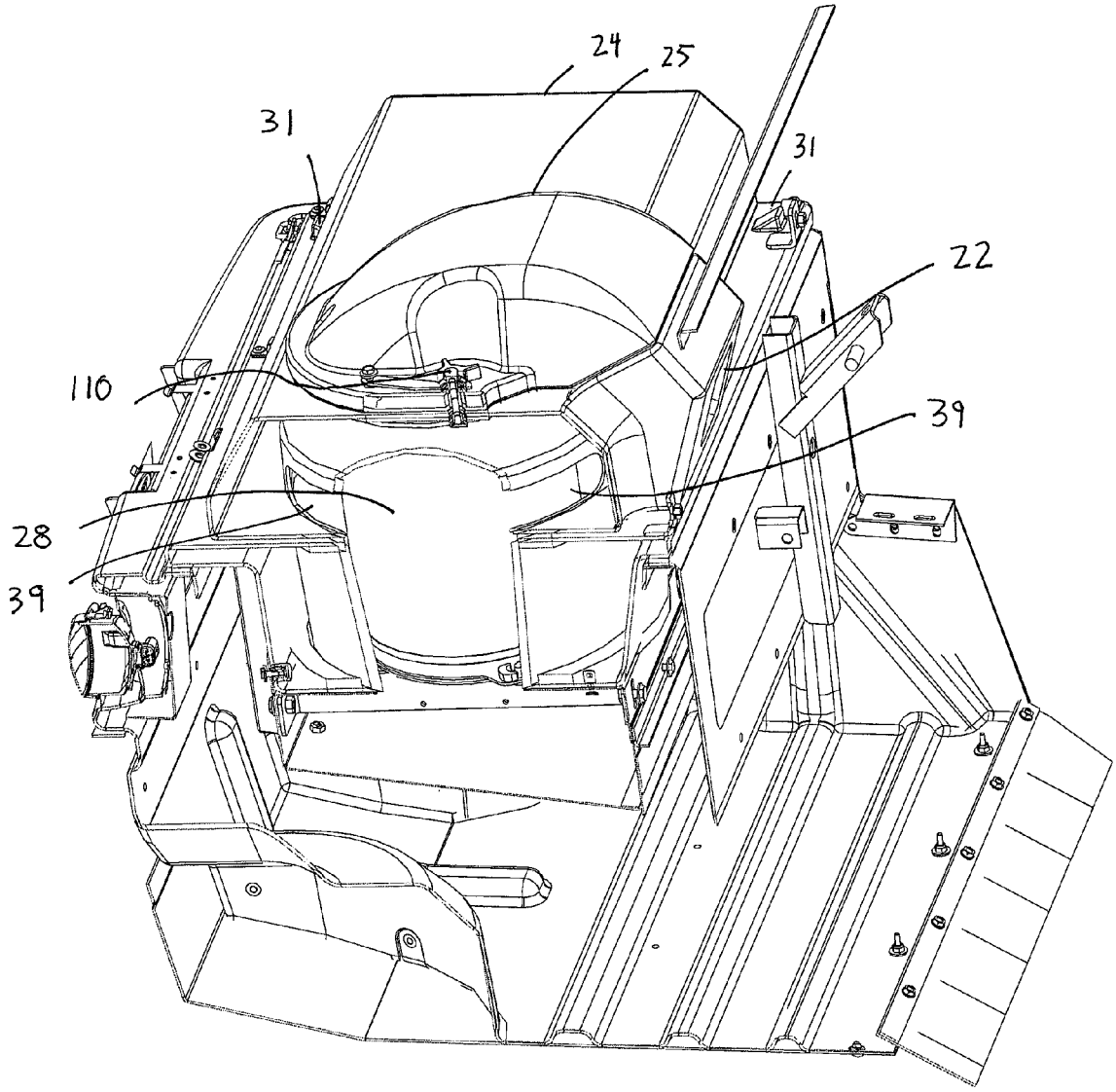
FIG. 11 is another cross-sectional view of the hopper assembly of FIG. 6.

FIG. 11 is another cross-sectional view of the hopper assembly 14 of FIG. 6 showing a pair of openings 39 flowing air from an interior of main cover 24 to the cylindrical filter for subsequent filtering. Filter cover 25 is separable from main cover 24 via threaded fasteners 110.

Figure 12:
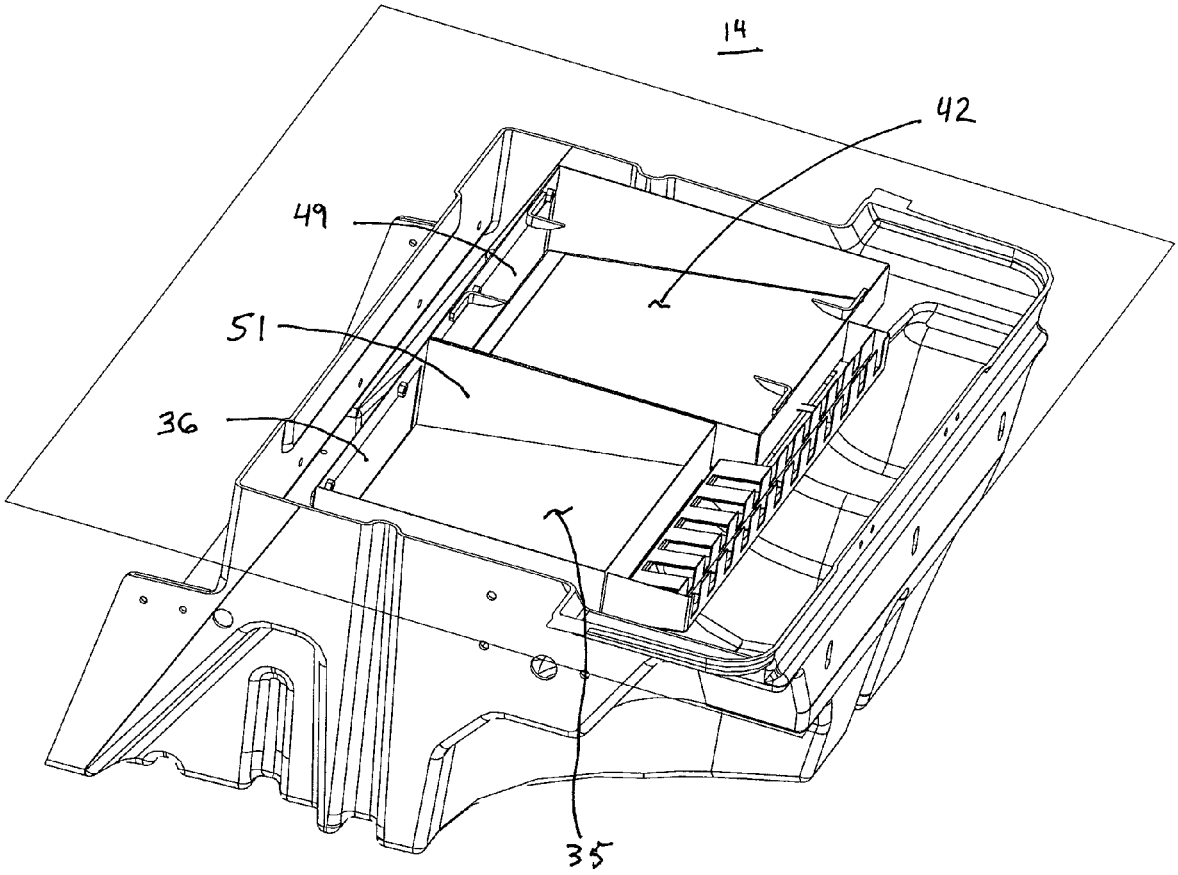
FIG. 12 is a cross-sectional view of the hopper assembly of FIG. 6.

FIG. 12 is a cross-sectional view of the hopper assembly 14 of FIG. 6 showing flexible seals 36, 49. Collection surface 35 is separated from collection surface 42 by wall 51. A pressure differential may exist across wall 51 as pressure within the vortex separator section may be different than pressure within the cylindrical filter section.

Figure 13:
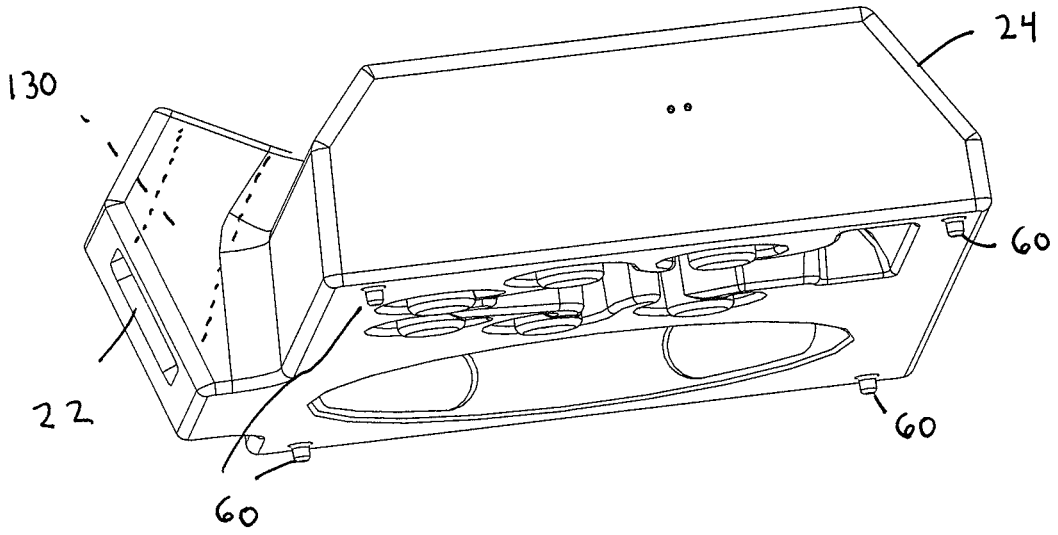
FIG. 13 is a perspective view of the main cover of the hopper assembly of FIG. 6.
Figure 14:
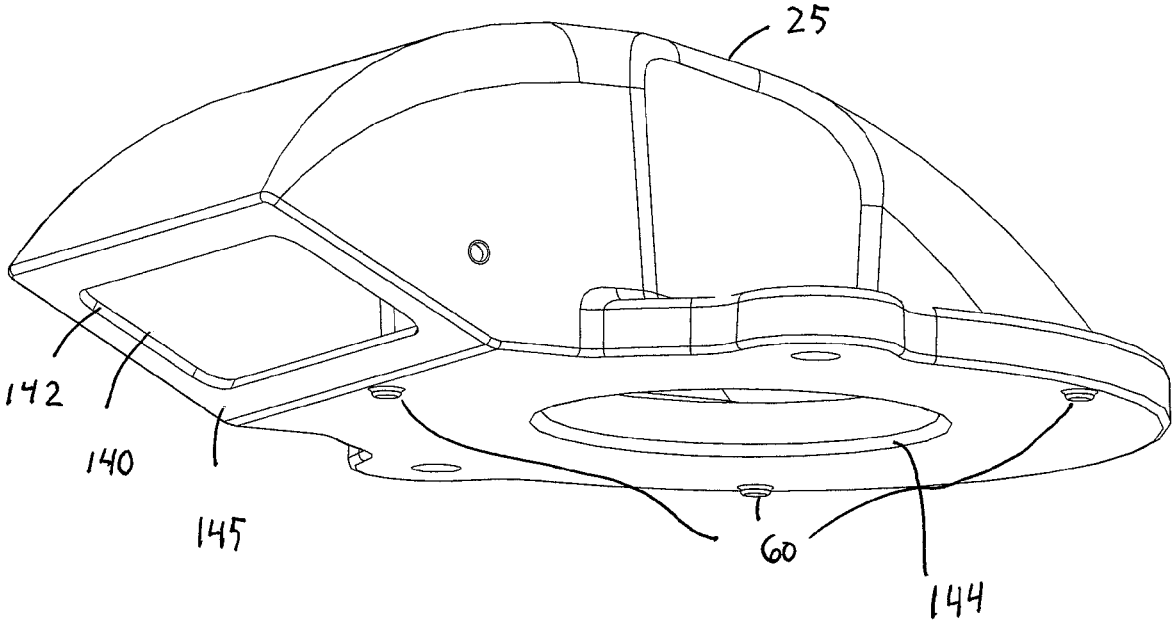
FIG. 14 is a perspective view of the filter cover of the hopper assembly of FIG. 6.

FIG. 13 is a perspective view of main cover 24 illustrating a plurality of bosses 60. FIG. 14 is a perspective view of filter cover 25 illustrating similar bosses 60. Main cover 24 includes air outlet 22 defined at one end of air conduit 130. Air conduit 130 is connected to air conduit 140 of filter cover 25, as shown in FIG. 14. Air conduit 140 is defined between a pair of ports 142, 144. Port 144 is in sealed communication with the interior of vacuum filter 28 during normal operation. Once assembled, a mating surface 145 engages a mating surface on main cover 24. A gasket can be provided to minimize air loss across the interface.

Figure 15:
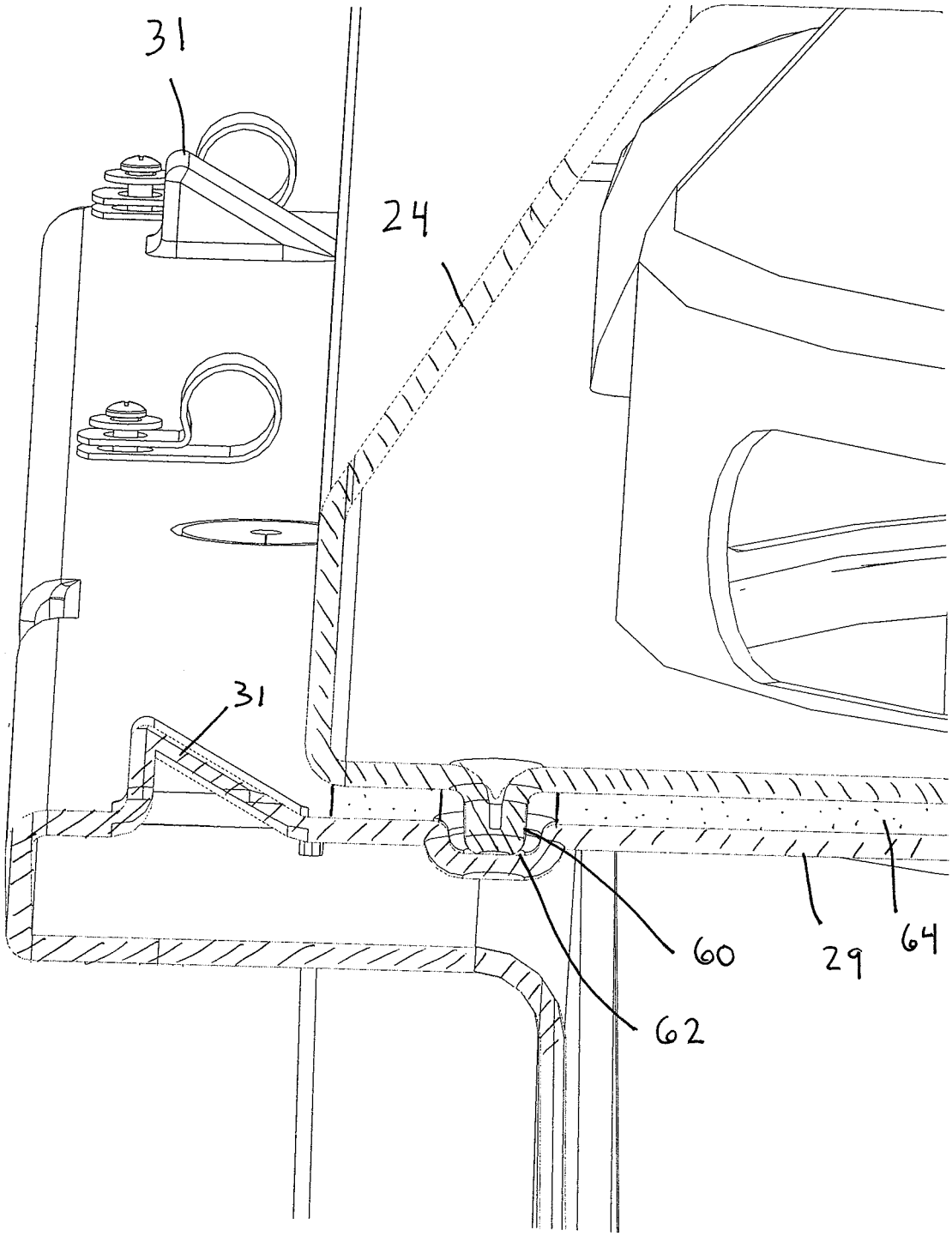
FIG. 15 is a cross-sectional view taken through the main cover and housing of the hopper assembly of FIG. 6.

FIG. 15 is a cross sectional view taken through a boss 60 of main cover 24 and housing 29. Boss 60 engages a pocket 62 in housing 29 to facilitate proper alignment of cover 24 to housing 29. Together boss 60 and pocket 62 control the degree of compression of gasket 64. Positioning ramps 31 and bosses 60/pockets 62 combine to facilitate proper alignment of the filter module components. Similarly, bosses 60 in filter cover 25 engage apertures in a gasket between filter cover 25 and main cover 24. Pockets may also be defined on an upper surface of main cover 24 to facilitate positioning of the assembly.

Figure 16:
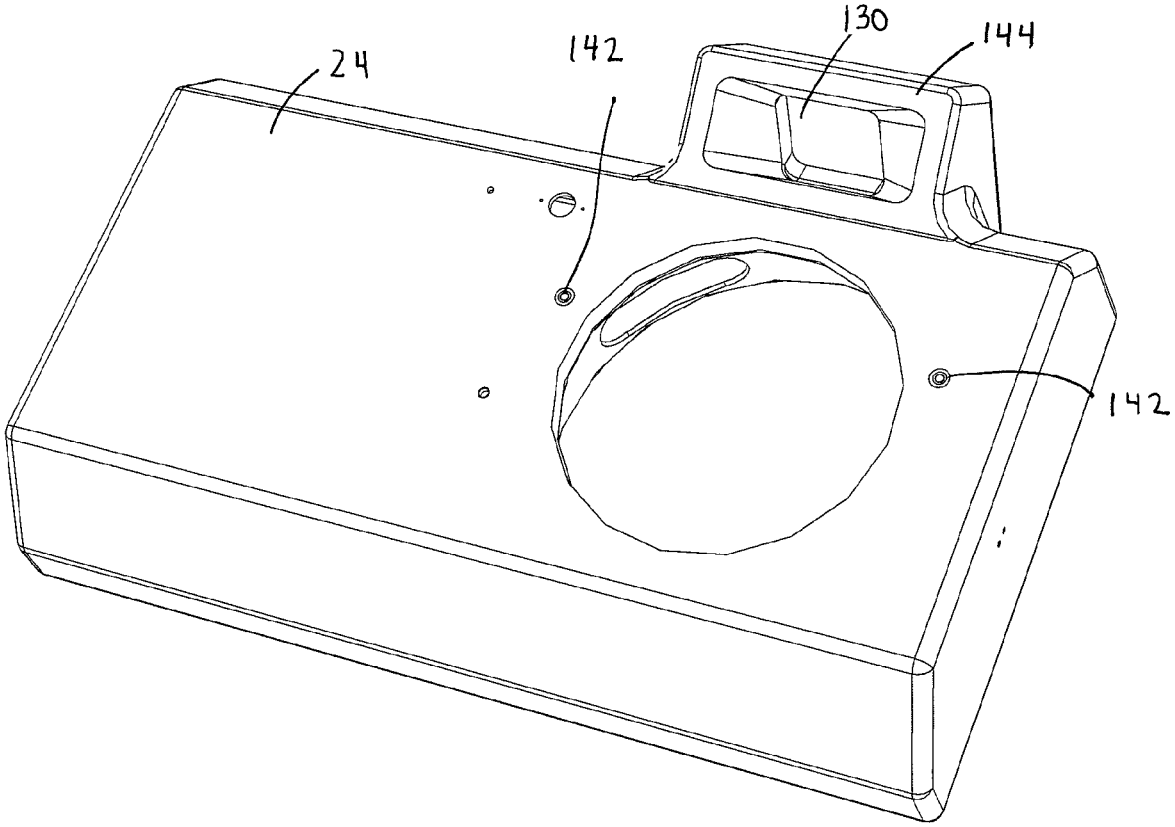
FIG. 16 is a top perspective view of the main cover of the hopper assembly of FIG. 6.

FIG. 16 is a top perspective view of main cover 24 showing filter opening 141 through which filter 28 can be accessed during inspection, replacement, etc. The filter cover 25 (not shown) is secured to main cover 24 by threaded fasteners (not shown) engaging threaded components 142. Main cover 24 defines an air conduit 130 through which filtered air travels toward vacuum fan 13. Conduit 143 includes a mating surface 144 which is sealed against a surface of filter cover 25.

Figure 17:
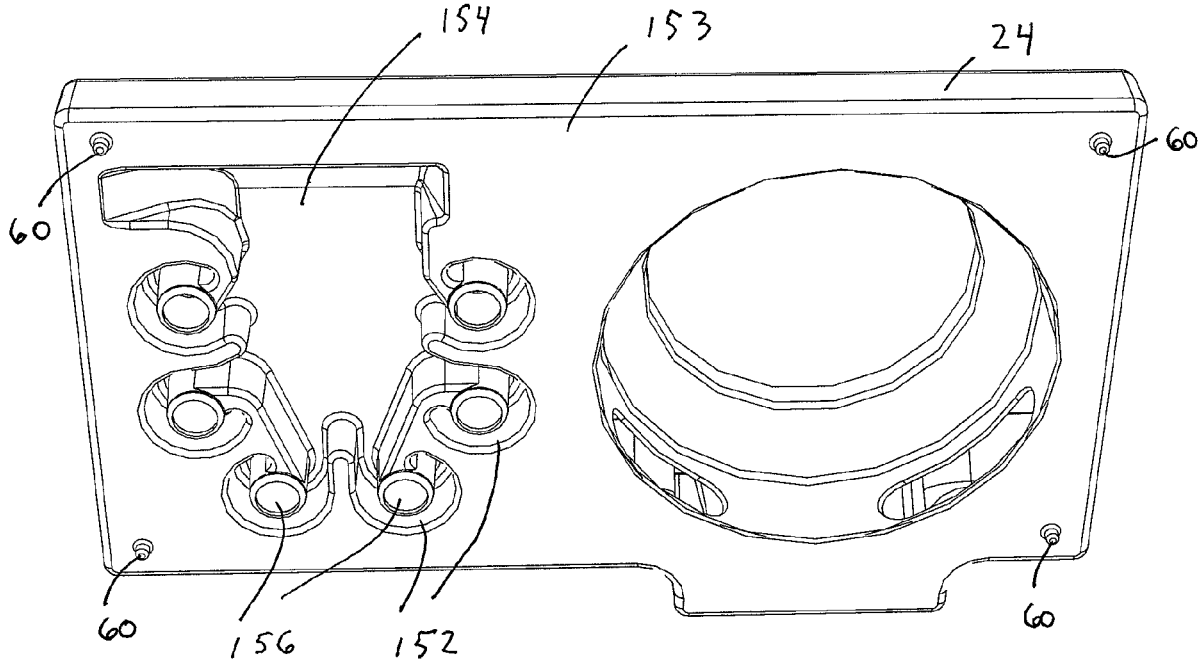
FIG. 17 is a bottom perspective view of the main cover of the hopper assembly of FIG. 6.

FIG. 17 is a bottom perspective view of main cover 24 showing a plenum portion 151 connected to a plurality of vortex-forming spiral walls 152. Some of the walls 152 spiral in one direction and other walls 152 spiral in an opposite direction. A lower surface 153 of main cover 24 engages tray 26 of the filter assembly. Dusty air from the hopper assembly enters plenum 151 at plenum entrance 154. Plenum 151 effectively distributes airflow across the various spiral walls 152 so as to maintain a balanced dust removal among the vortex separators. Air exits this portion of main cover 24 through openings 156 and passes into a generally enclosed volume of cover 24.

Figure 18:
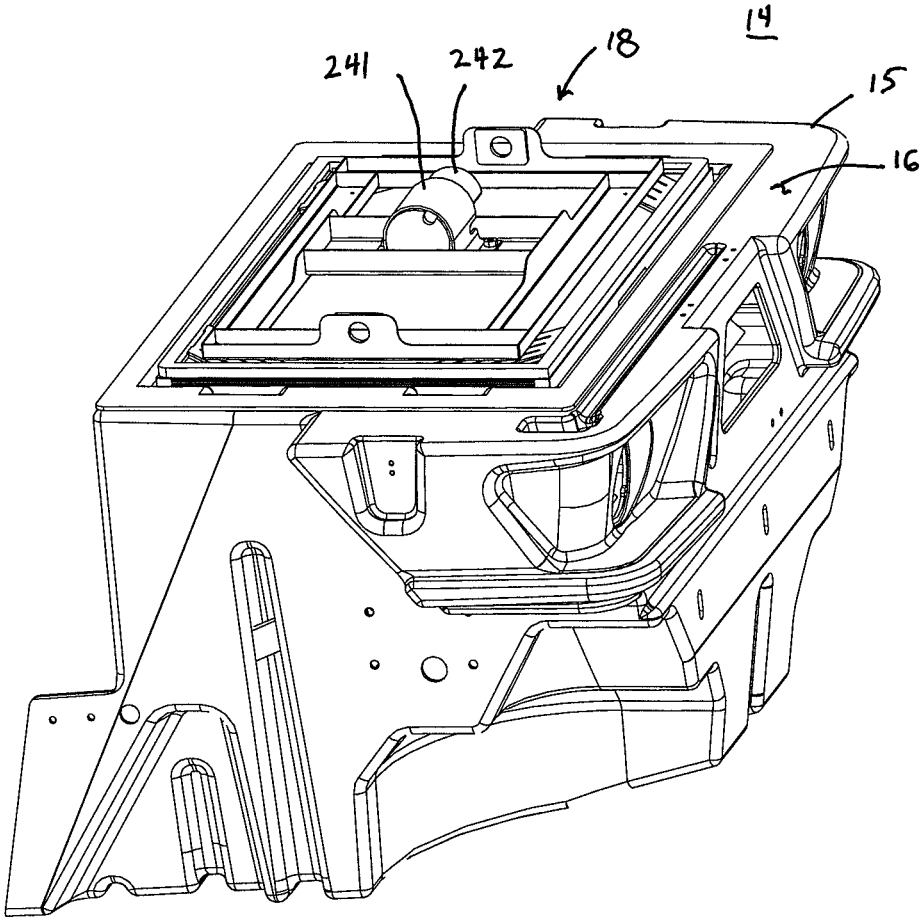
FIG. 18 is a perspective illustration of another embodiment of a filter module within a hopper assembly in accordance with the present invention.

FIG. 18 is a perspective illustration of filter module 18 supported upon flange 16 of debris hopper 15. A filter shaker mechanism includes electric motor 241 coupled by its shaft to eccentric weight 242.

Figure 19:
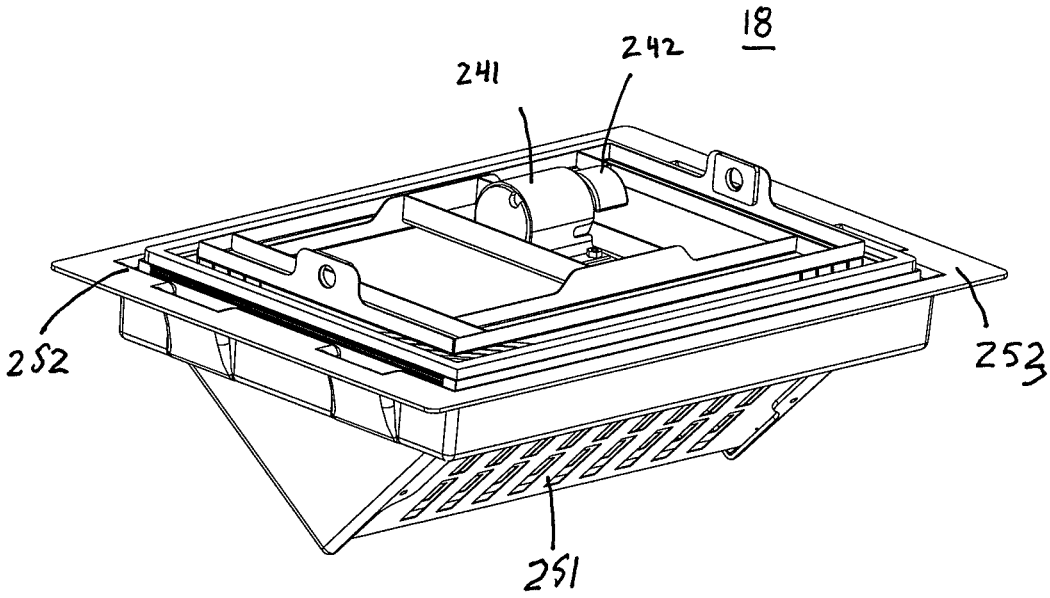
FIG. 19 is a detailed perspective view of the filter module of FIG. 18.

FIG. 19 is a perspective view of components of filter module 18, particularly showing prefilter 251 and support frame 252. An upper flange 253 is sized to engage flange surface 16 of the debris hopper 15 thereby supporting filter module 18 within hopper top aperture.

Figure 20:
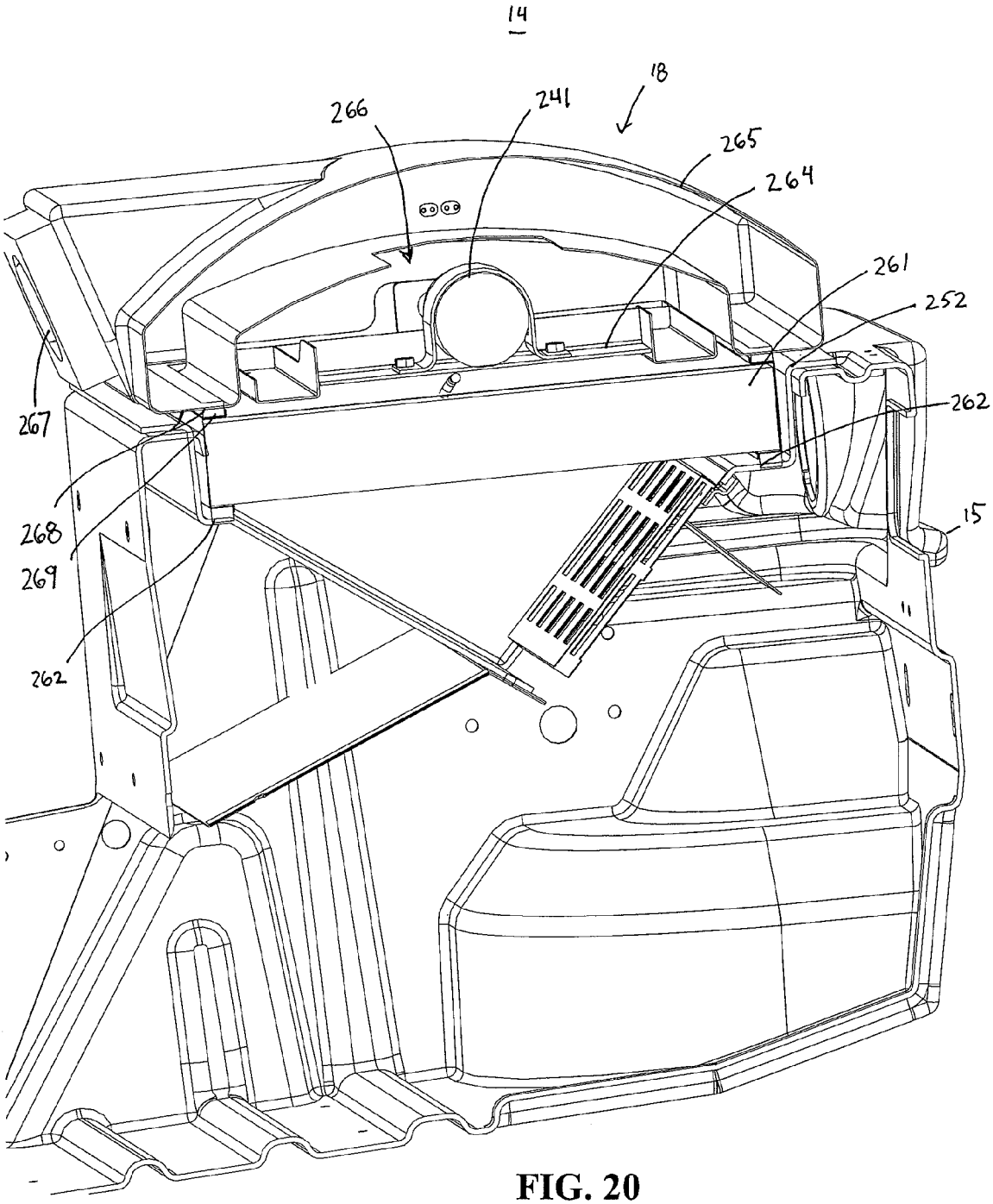
FIG. 20 is a cross-sectional view of a hopper assembly and filter module of FIG. 18.

FIG. 20 is a cross-sectional view of the hopper assembly 14 incorporating panel filter module 18. Panel filter 261 is supported by bottom flange 262 of support frame 252. Shaker motor 241 is shown positioned toward one side of hopper assembly 14. Shaker motor 241 is coupled to a shaker frame 264 which engages panel filter support frame 252. During operation of shaker motor 241, the shaker frame, support frame 252 and panel filter 261 are vibrated to loosen dust and debris on panel filter 261.

Figure 21:
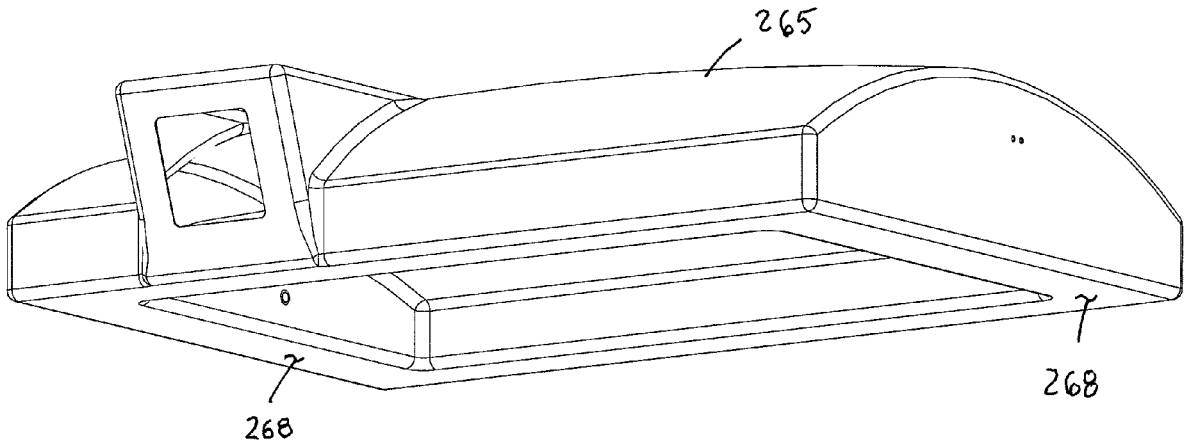
FIG. 21 is a perspective view of a panel filter cover of the filter module of FIG. 18.

Panel filter cover 265 includes an inlet aperture 266 through which filtered air is drawn by vacuum action toward and through outlet 267. In the illustrated embodiment, cover 265 is a blow-molded component having an open interior. Cover 265 includes a lower surface 268 as shown in FIG. 21 which engages panel filter 261 and/or support frame 252 to seal the assembly from air leakage. In the illustrated embodiment of panel filter 261, a flexible structure 269 such as a foam seal is engaged at a top part of filter 261 by filter cover 265 and at a lower part of filter 261 by flange 262 of support frame 252.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A mobile surface maintenance machine comprising:

a debris hopper movable between an operational position and a debris dump position;

an exhaust conduit in air communication with the debris hopper when the debris hopper is in said operational position; and an exhaust fan in air communication with the exhaust conduit and drawing an airstream [air]through the debris hopper when the debris hopper is in said operational position, with said debris hopper having a debris inlet into which dust and debris is thrown by a sweeping brush or drawn in to the debris hopper by action of said exhaust fan, said debris hopper having an upper opening supporting a filter module, said filter module providing two filter stages for separating dust and debris from the airstream, with a first filter stage including a plurality of cone-shaped vortex separators having open lower ends through which dust and debris are removed from the airstream, and the second filter stage receiving the airstream from the first filter stage and including a rigid cylindrical filter having a pair of open ends and a cylindrical interior and an exterior upon which dust and debris are removed from the airstream, with the filter module having a debris collection surface and a movable flap for retaining dust and debris removed from airstream at the first filter stage and second filter stage upon the collection surface, said movable flap being held closed by way of vacuum action from the exhaust fan and being released to swing open when the hopper is in the debris dump position, with the collection surface of the two filter stages being separated by a wall allowing a pressure differential to exist thereacross, and said filter module including a filter shaking mechanism having an electric motor positioned substantially within the cylindrical interior of the cylindrical filter and with at least one eccentric weight being attached to a motor shaft positioned within the interior of the cylindrical filter, with said electric motor being secured to a plate sealing one of said open ends of the cylindrical filter, and with said airstream passing out of the other of said of open ends of the cylindrical filter, and a housing adapted to seal against said upper opening of the debris hopper, and wherein said exhaust conduit is removed from air communication with the debris hopper when the debris hopper is in said debris dump position.

2. The mobile surface maintenance machine of claim 1 wherein said at least two filter stages includes a prefilter and a panel filter.

3. The mobile surface maintenance machine of claim 1 wherein the filter module includes a housing and a main cover, with said main cover including a plurality of bosses for engaging a plurality of pockets defined on said housing, together said plurality of bosses and said plurality of pockets limiting a degree to which a gasket between said housing and said main cover is compressed.

4. The mobile surface maintenance machine of claim 1 wherein the filter module includes a housing and a main cover, said housing defining a plurality of ramps for guiding the main cover into a proper position.

5. A mobile surface maintenance machine comprising:

a debris hopper movable between an operational position and a debris dump position, said debris hopper having a debris inlet into which dust and debris is thrown by a sweeping brush or drawn in to the debris hopper by action of an exhaust fan, said debris hopper having an upper opening; and a filter module positioned within the upper opening of the debris hopper and comprising two filter stages for separating dust and debris from the airstream, with a first filter stage including a plurality of cone-shaped vortex separators having open lower ends through which dust and debris are removed from an airstream, and the second filter stage receiving the airstream from the first filter stage and including a rigid cylindrical filter having a pair of open ends and a cylindrical interior and an exterior upon which dust and debris are removed from the airstream, with the filter module having a debris collection surface and a movable flap for retaining dust and debris removed from airstream at the first filter stage and second filter stage upon the collection surface, said movable flap being held closed by way of vacuum action from the exhaust fan and being released to swing open when the hopper is in the debris dump position, with the collection surface of the two filter stages being separated by a wall allowing a pressure differential to exist thereacross, and said filter module including a filter shaking mechanism having an electric motor positioned substantially within the cylindrical interior of the cylindrical filter, with said electric motor being secured to a plate sealing one of said open ends of the cylindrical filter, and with said airstream passing out of the other of said of open ends of the cylindrical filter.

6. The mobile surface maintenance machine of claim 5 wherein said at least two filter stages includes a prefilter and a panel filter.

7. The mobile surface maintenance machine of claim 5 wherein a shaft of the motor is attached to at least one eccentric mass for inducing vibrations to the cylindrical filter during a filter shaking procedure.

8. The mobile surface maintenance machine of claim 5 wherein the filter module includes a housing and a main cover, with said main cover including a plurality of bosses for engaging a plurality of pockets defined on said housing, together said plurality of bosses and said plurality of pockets limiting a degree to which a gasket between said housing and said main cover is compressed.

9. The mobile surface maintenance machine of claim 5 wherein the filter module includes a housing and a main cover, said housing defining a plurality of ramps for guiding the main cover into a proper position.

10. A mobile surface maintenance machine comprising:

a debris hopper movable between an operational position and a debris dump configuration, said debris hopper having a debris inlet into which dust and debris is thrown by a sweeping brush or drawn in to the debris hopper by action of an exhaust fan when said debris hopper is in said operational position; and a filter module retained against an upper opening of the debris hopper, said filter module providing two filter stages for separating dust and debris within the debris hopper, with a first filter stage including a plurality of cone-shaped vortex separators having open lower ends through which dust and debris are removed from an airstream, and the second filter stage receiving the airstream from the first filter stage and including a rigid cylindrical filter having a pair of open ends and a cylindrical interior and an exterior upon which dust and debris are removed from the airstream, with the filter module having a debris collection surface and a movable flap for retaining dust and debris removed from airstream at the first filter stage and second filter stage upon the collection surface, said movable flap being held closed by way of vacuum action from the exhaust fan and being released to swing open when the hopper is in the debris dump position, and said filter module including a filter shaking mechanism having an electric motor positioned substantially within the cylindrical interior of the cylindrical filter, with said electric motor being secured to a plate sealing one of said open ends of the cylindrical filter, and with said airstream passing out of the other of said of open ends of the cylindrical filter.

11. The mobile surface maintenance machine of claim 10 wherein the motor is attached to at least one eccentric mass for inducing vibrations to the cylindrical filter during a filter shaking procedure.

12. The mobile surface maintenance machine of claim 10 wherein the cylindrical filter is retained into the module by a filter cover, said filter cover defining an interior conduit through which air flows with one end of the interior conduit being coupled to a filter interior and the other end of the interior conduit terminating at a mating surface, said mating surface adapted to engage a mating surface on a main filter cover.

13. The mobile surface maintenance machine of claim 10 further comprising a wall separating two portions of the debris collection surfaces, with a pressure differential existing across the wall when the exhaust fan is operational.

* * * * *

UNITED STATES PATENT AND TRADEMARK OFFICE

CERTIFICATE OF CORRECTION

PATENT NO. : 8,458,855 B2
APPLICATION NO. : 12/396440
DATED : June 11, 2013
INVENTOR(S) : Wilmo It is certified that error appears in the above-identified patent and that said Letters Patent is hereby corrected as shown below:

In the Claims:

Col. 6, line 43, In Claim 1, delete “air”.

Signed and Sealed this
Third Day of September, 2013

Teresa Stanek Rea
*Acting Director of the United States Patent and Trademark Office*